US011464338B2

(12) United States Patent
Heinzelman et al.

(10) Patent No.: US 11,464,338 B2
(45) Date of Patent: Oct. 11, 2022

(54) NO-TOOL ASSEMBLY CHAIR

(71) Applicant: Elite Outdoor, Inc, Mooresville, NC (US)

(72) Inventors: Todd Heinzelman, Mooresville, NC (US); Michael Ortiz, Mooresville, NC (US)

(73) Assignee: Elite Outdoor, Inc., Mooresville, NC (US)

( * ) Notice: Subject to any disclaimer, the term of this patent is extended or adjusted under 35 U.S.C. 154(b) by 0 days.

(21) Appl. No.: 17/165,629

(22) Filed: Feb. 2, 2021

(65) Prior Publication Data

US 2022/0240679 A1 Aug. 4, 2022

(51) Int. Cl.
*A47C 4/02* (2006.01)
*A47C 5/02* (2006.01)
*A47C 4/03* (2006.01)

(52) U.S. Cl.
CPC ..... *A47C 4/02* (2013.01); *A47C 4/03* (2013.01); *A47C 5/02* (2013.01)

(58) Field of Classification Search
CPC ..... A47C 4/02; A47C 5/02
USPC ..... 297/440.15, 440.17
See application file for complete search history.

(56) References Cited

U.S. PATENT DOCUMENTS 177,891 A * 5/1876 Skoog ..... A47C 4/02 297/440.22
802,089 A * 10/1905 Scherrer ..... A47C 4/02 297/440.17
2,574,289 A * 11/1951 Rossi ..... A47D 1/006 297/134
2,650,657 A * 9/1953 Folke ..... A47C 4/02 297/440.23
3,504,942 A * 4/1970 Wong ..... A47C 5/02 297/440.23
4,254,992 A * 3/1981 Orosa ..... A47C 5/02 297/134
10,925,402 B2 * 2/2021 Coleman ..... A47C 7/42
2020/0156514 A1 * 5/2020 Sweeney ..... A47C 4/028
2020/0260877 A1 * 8/2020 Wu ..... F16B 12/32

FOREIGN PATENT DOCUMENTS

CN 215015396 U * 12/2021
DE 3733450 A * 4/1988 ..... A47C 4/02
EP 399894 A * 11/1990 ..... A47C 11/005
FR 2344205 A * 11/1977 ..... A47C 4/02

* cited by examiner

*Primary Examiner* — Robert Canfield
(74) *Attorney, Agent, or Firm* — GableGotwals; David G. Woodral

(57) ABSTRACT

A chair adapted for no-tool assembly that includes a lower chair frame supported by an upper chair frame. A first, e.g., front, interface prevents relative movement between the chair frames, e.g., via orifice engaging a protrusion of, e.g., a hook member, or engagement of mating caps of the upper and lower chair frames with protrusions and orifices. A second, e.g., second interface includes a latch receiver and latch. In use, the upper chair frame is placed on the lower chair frame. The first interface is engaged for preventing relative movement between the upper and lower chair frames and the second interface between the lower chair frame and the upper chair frame is also engaged.

14 Claims, 13 Drawing Sheets

NO-TOOL ASSEMBLY CHAIR

FIELD OF THE INVENTION

A chair is made of two portions that are assembled without the use of tools or loose hardware. More particularly, an upper chair frame is attached to a lower chair frame by connecting a hook on one side of the assembly and a latch mechanism on another side of the assembly.

BACKGROUND OF THE INVENTION

With the advent of e-commerce, consumers are increasingly turning to mail order for all manner of consumer goods including furniture.

It is desirable to ship large items, such as furniture, in the smallest packages possible to avoid shipping charges. However, counterbalancing the desire for small packaging is customer convenience as it relates to post-shipping assembly. One compromise between these two objectives is to ship articles in separate, pre-assembled pieces, thereby necessitating only the assembly of several pieces rather than, potentially dozens of pieces.

Chair frames are known that are made up of upper and lower portions that may be joined to one another via a variety of attachment means, including but not limited to: nuts and bolts, screws, nails, pressure-fittings, thumbscrews, knobs, spring-pins, snaps, rivets, etc.

SUMMARY OF THE INVENTION

It is desirable to provide a piece of furniture, such as a chair, that may be assembled easily with no-tools, thereby providing for low cost shipping and maximizing consumer convenience. Although the invention is discussed in terms of a chair, it should be understood that other forms of furniture may also utilize the attachment features of the invention, including love seats, sofas, etc.

The chair of the invention is adapted for no-tool assembly. The chair includes a lower chair frame and an upper chair frame supported by the lower chair frame.

A front interface is provided between the lower chair frame and the upper chair frame for preventing relative movement between the lower chair frame and the upper chair frame. In one embodiment, the front interface includes an orifice on at least one of the lower chair frame and the upper chair frame and a protrusion for being received in the orifice, the protrusion on an opposite one of the lower chair frame and the upper chair frame. The protrusion is preferably a terminal end of a hook member.

In one embodiment, the lower chair frame has a first front leg and a second front leg connected by a front cross member and the upper chair frame has a front cross member. One of the front cross member of the lower chair frame and the front cross member of the upper chair frame define the protrusion for being received in the orifice.

In one embodiment, the upper chair frame has a first front upright member and a second front upright member, each of which defines a lower end. At least one of the lower ends of the first front upright member and the second front upright member is covered with a cap that defines the front interface. In one embodiment, the front interface includes at least one of the orifice and the protrusion.

The front interface is additionally found on the lower chair frame. The lower chair frame has a first front leg and a second front leg, each of which define an upper end. At least one of the upper ends of the first front chair leg and the second front chair leg are covered with a cap, wherein the cap defines the front interface. In one embodiment, the front interface has at least one of the orifice and the protrusion.

In one embodiment, the rear interface includes a latch receiver on one of the lower chair frame and the upper chair frame and a latch for engaging the latch receiver. The latch is positioned on an opposite one of the lower chair frame and the upper chair frame.

In use, the upper chair frame is placed on the lower chair frame. The front interface between the lower chair frame and the upper chair frame is engaged for preventing relative movement between the lower chair frame and the upper chair frame. In greater detail, protrusions and orifices are matingly received on the caps of the upper chair frame and the lower chair frame. Additionally, terminal ends of hooks are slidingly received in mating orifices between the upper chair frame and lower chair frame.

The rear interface between the lower chair frame and the upper chair frame is engaged for preventing relative movement between the lower chair frame and the upper chair frame.

The upper chair frame and lower chair frame may be constructed using steel, aluminum, wood, vinyl, nylon, plastics, other materials or any combination of these materials.

The hook(s) may be constructed using steel, aluminum, zinc, metal, wood, vinyl, nylon, plastics, other materials, or any combination of these materials.

The latch mechanism(s) may be constructed using steel, aluminum, zinc, metal, wood, vinyl, nylon, plastics, other materials or any combination of these materials.

DETAILED DESCRIPTION OF THE PREFERRED EMBODIMENTS

Figure 1:
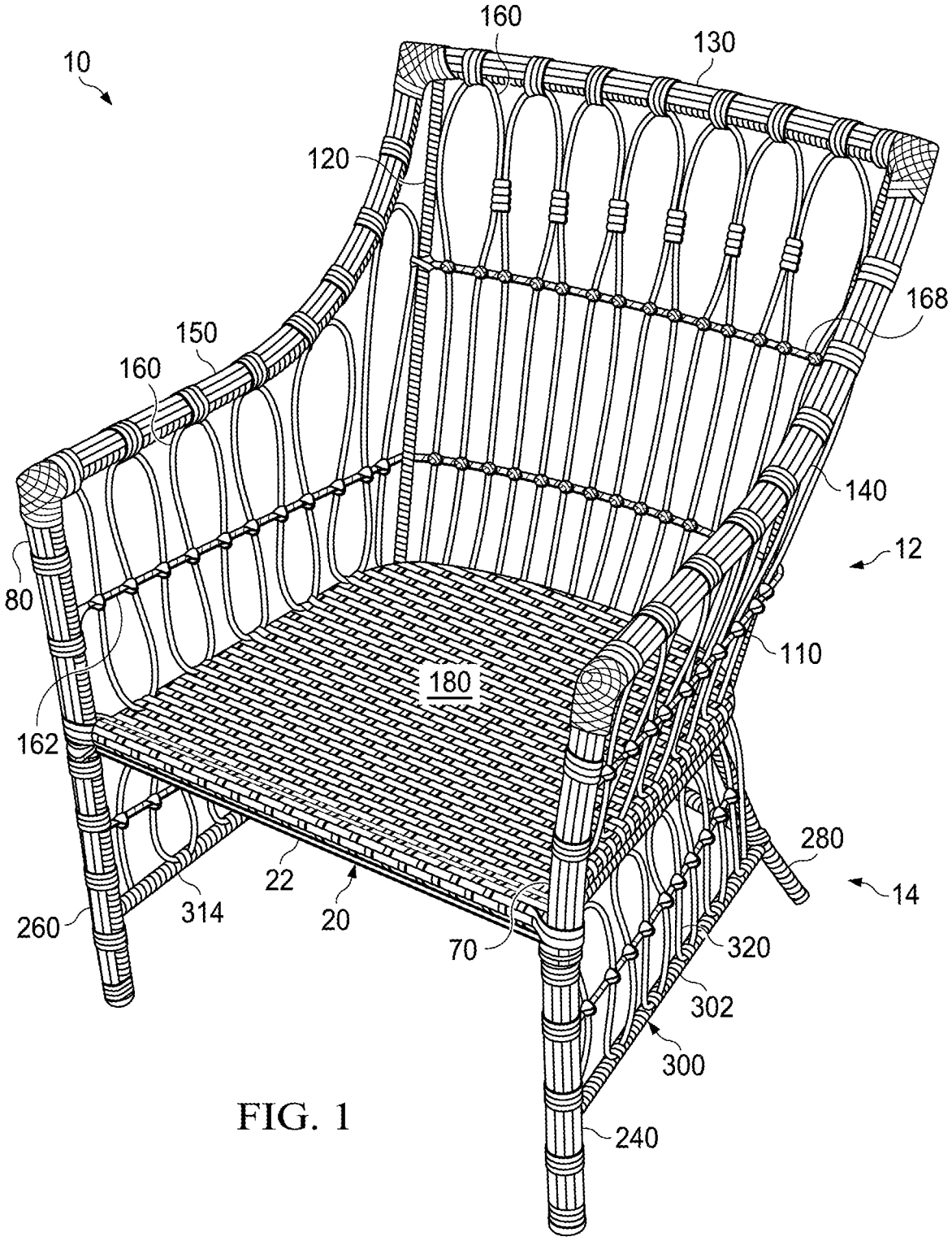
FIG. 1 is a perspective view of the chair of the invention having a lower chair frame and an upper chair frame.
Figure 2:
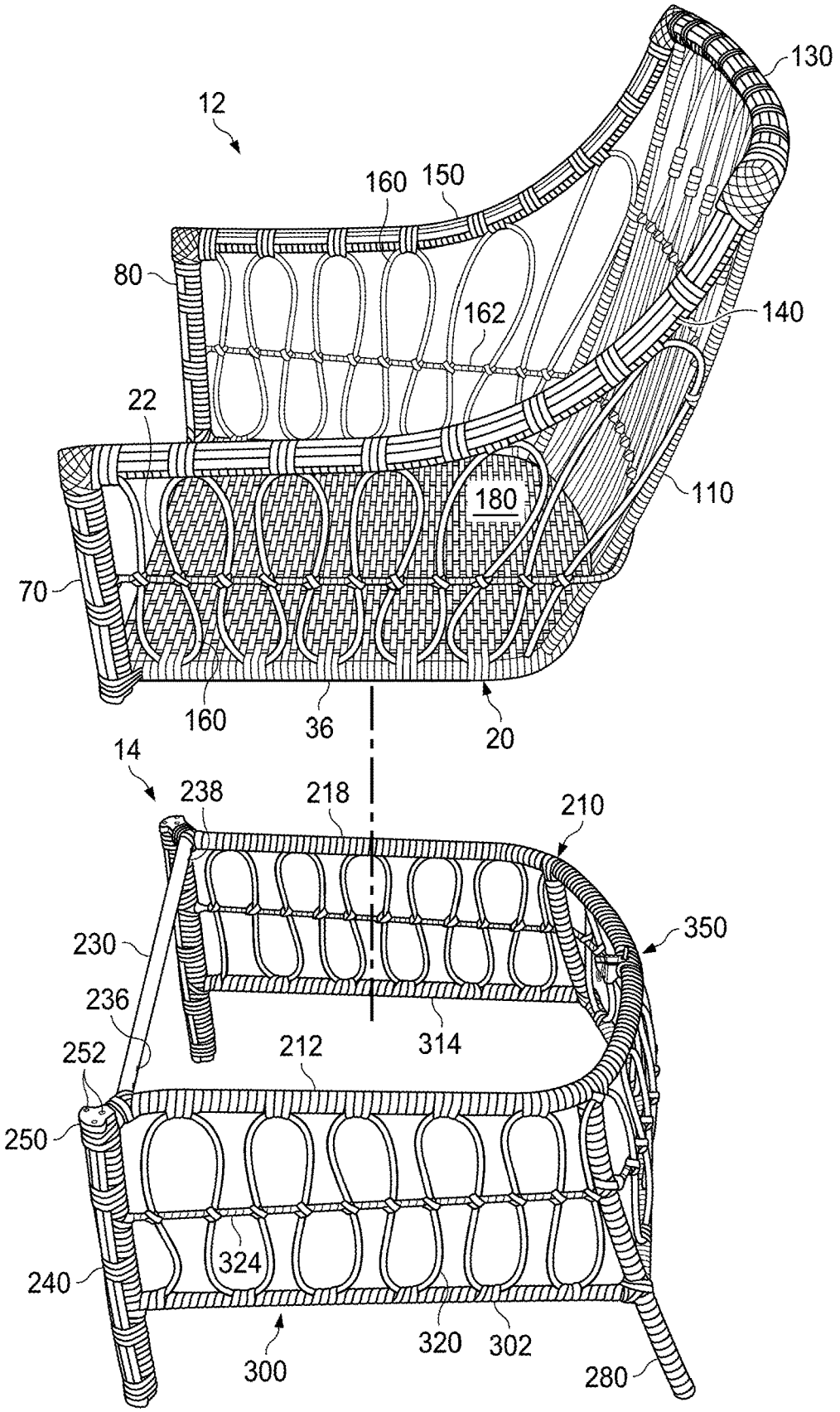
FIG. 2 is a perspective view of the chair of FIG. 1 showing the upper chair frame separated from the lower chair frame.
Figure 3:
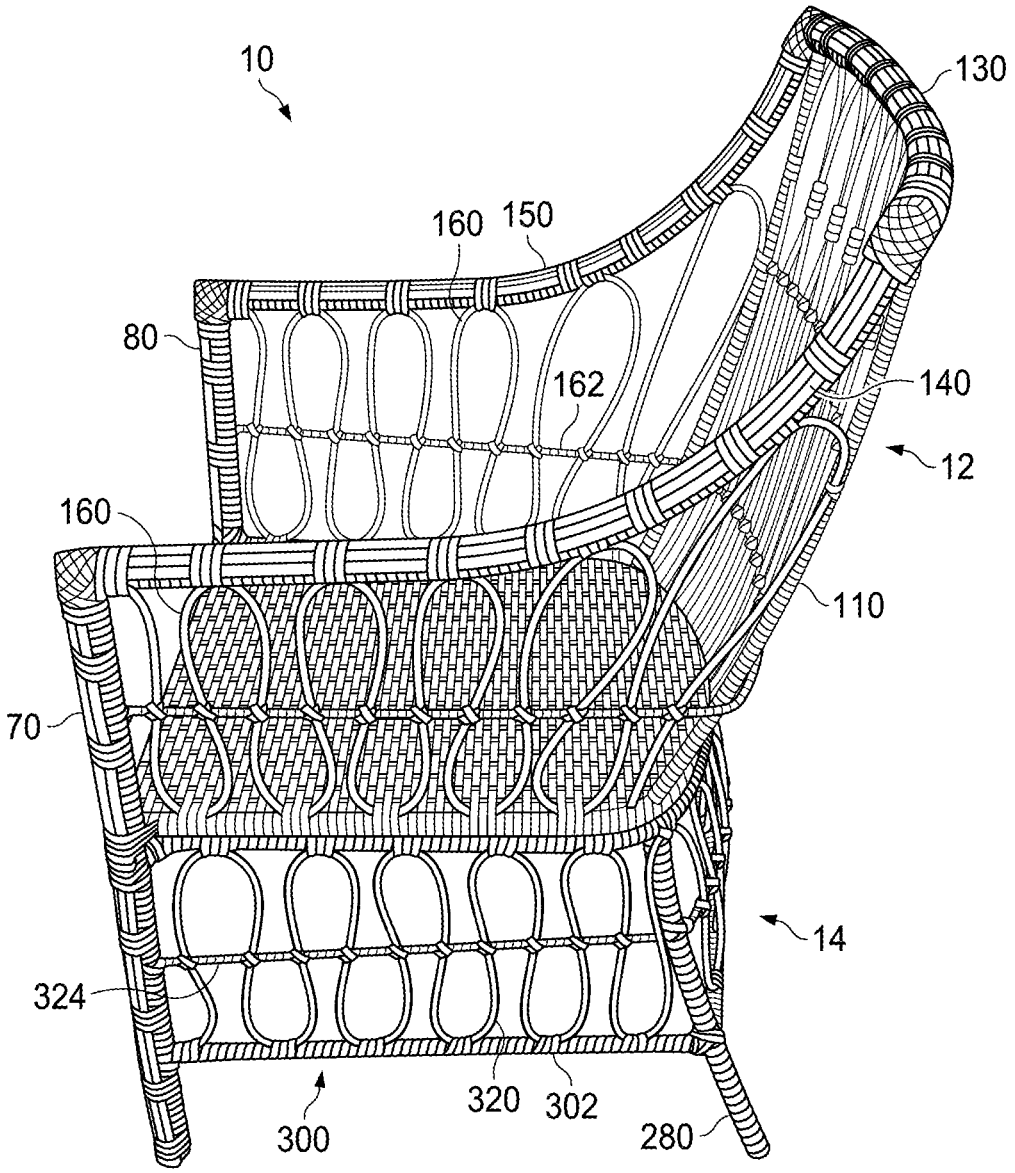
FIG. 3 is a perspective view of the chair of FIG. 1.
Figure 4:
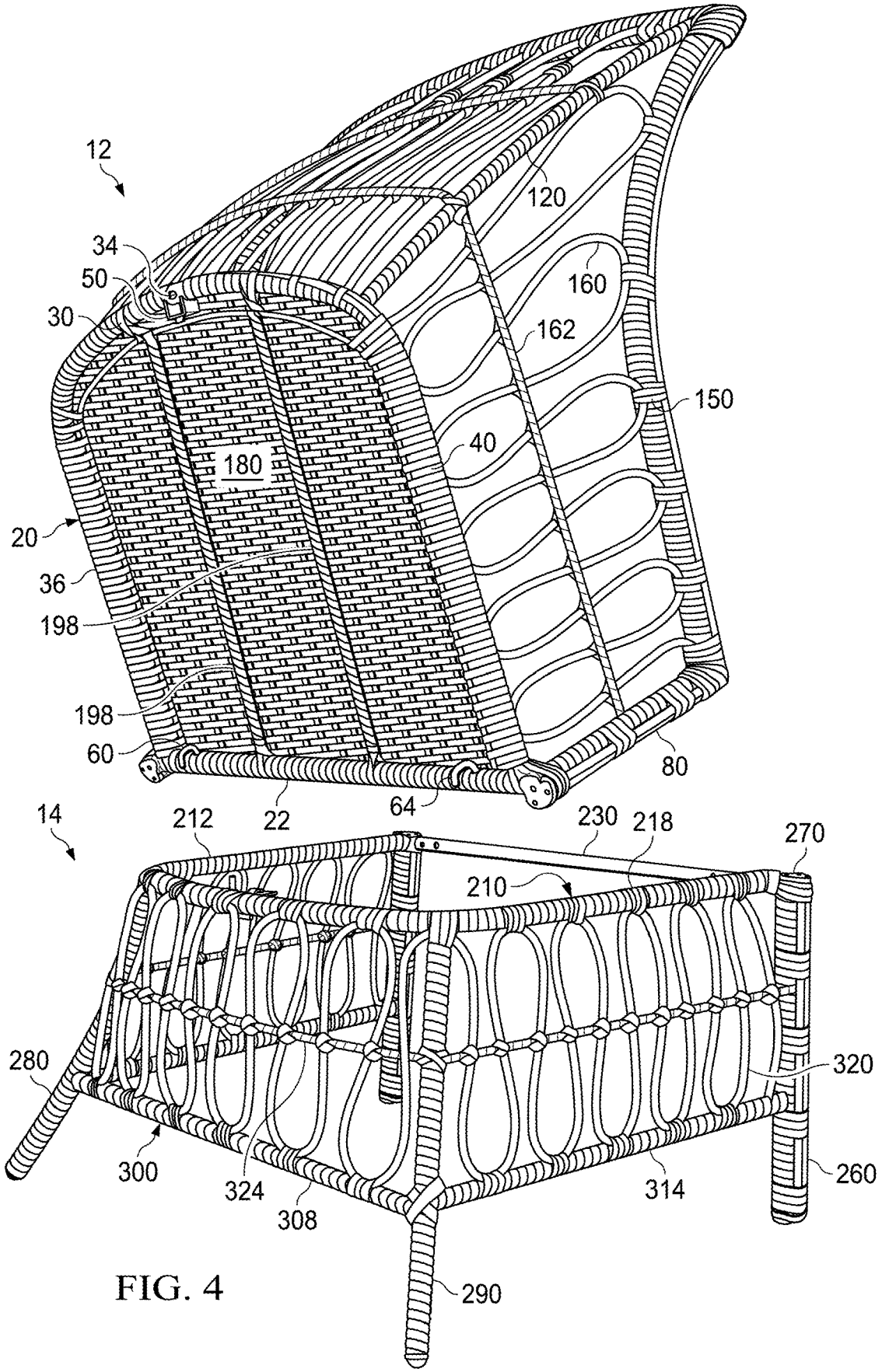
FIG. 4 is a perspective view of the chair of FIG. 1 showing the upper chair frame separated from the lower chair frame wherein a bottom of the upper chair frame if visible.
Figure 5:
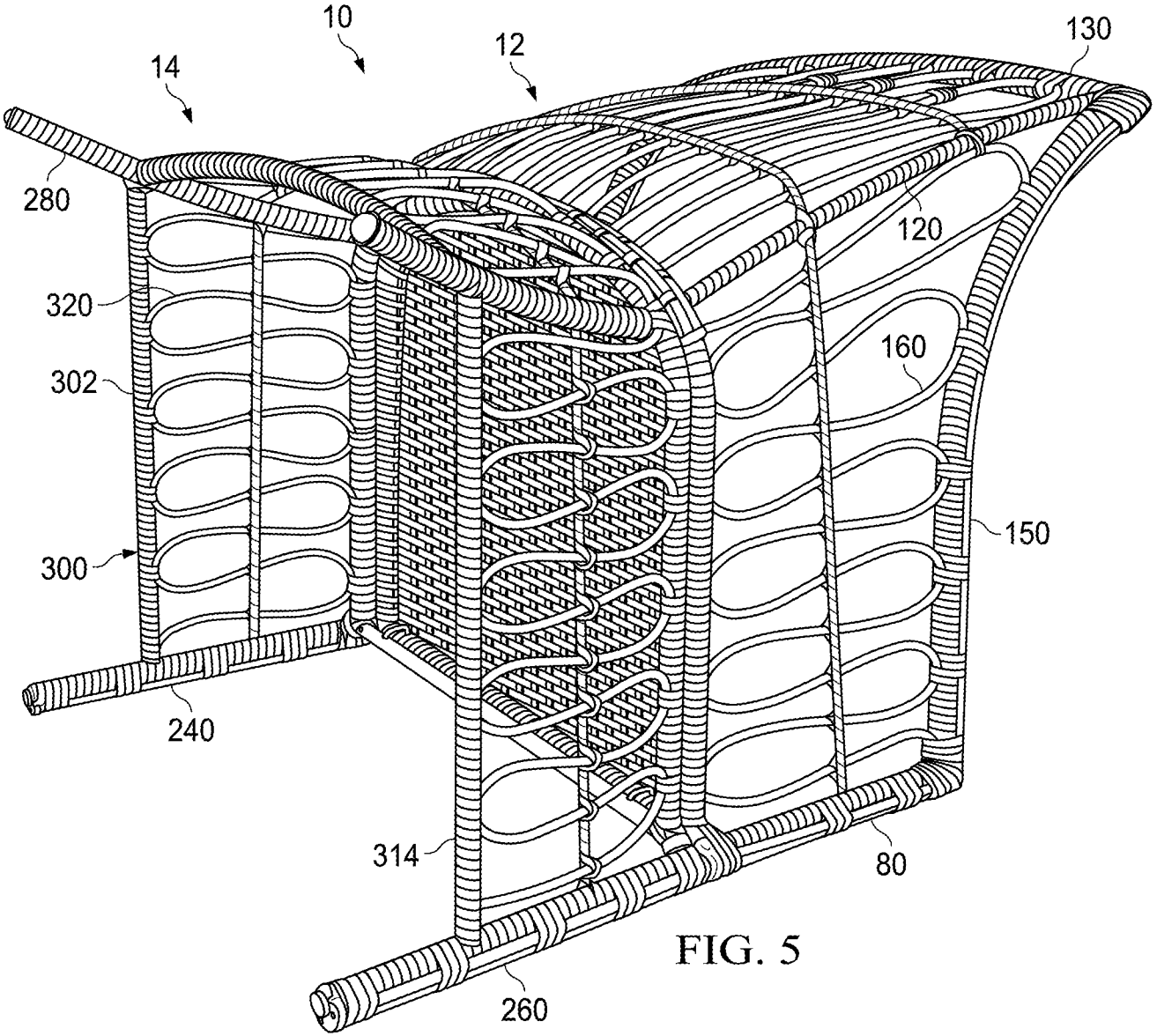
FIG. 5 is a perspective view of the chair of FIG. 1.

A chair frame is made of two portions that are assembled without the use of tools or loose hardware. The top portion of the chair frame is attached to the lower portion of the chair frame by first connecting hook on one side of the assembly and a latch mechanism on another side of the assembly.

Shown in the figures is a chair designated generally 10, which is adapted for no-tool assembly. Chair 10 has an upper chair frame 12 and a lower chair frame 14.

Seat frame 20 of upper chair frame 12 includes front tube 22 having a first end, a second end, and a rear side. Seat frame 20 includes rear. Rear tube 30 has a first end, a second end, and a lower side. The lower side of rear tube 30 defines rear orifice 34. Seat frame 20 additionally includes first side tube 36 having a front end proximate to the first end of front tube 22. First side tube 36 additionally has a rear end. Seat frame 20 additionally includes second side tube 40 having a front end proximate to the second end of front tube 22. Second side tube 40 additionally has a rear end.

Latch receiver support 50 extends forwardly from rear tube 30. Latch receiver support 50 has a latch receiver 52 thereon.

First hook 60 extends from the rear side of front tube 22. First hook 60 has a terminal end that extends forwardly.

Second hook 64 extends from the rear side of front tube 22 and has a terminal end 66 that extends forwardly.

First front upright tube 70 extends above and is proximate to the first end of front tube 22 and to the front end of front side tube 36. First front upright tube 70 has a top surface and a lower surface.

Second front upright tube 80 extends above and is proximate to the second end of front tube 22 and to the front end of second side tube 40. Second front upright tube 80 has a top surface and has a lower surface.

First cap 90 is located on the lower surface of first front upright tube 70. First cap 90 defines first upper interface members 92. Upper interface members 92 may be orifices, protrusions, or other members for engaging a mating cap.

Figure 6A:
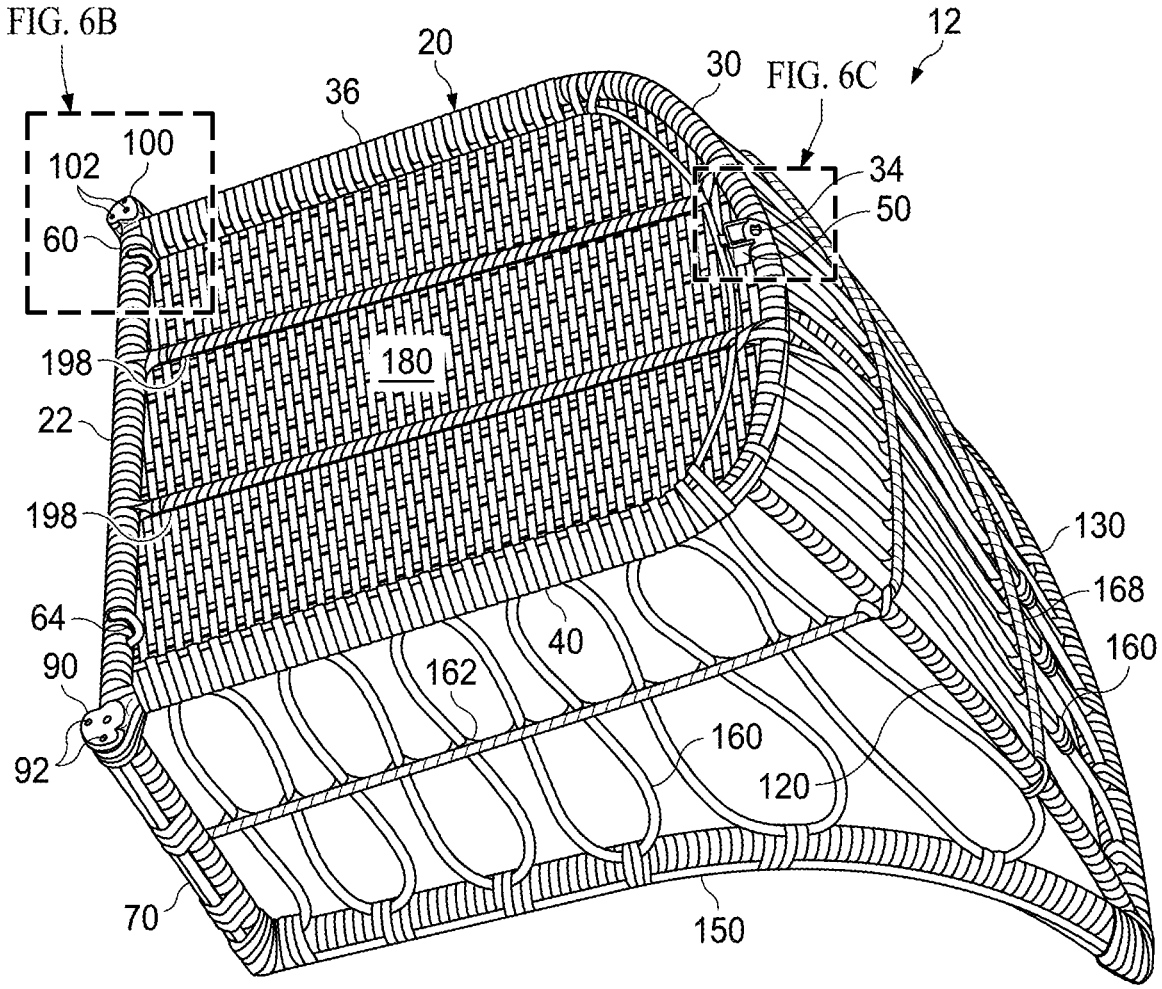
FIG. 6A is a perspective view of the upper chair frame of FIG. 1.
Figure 6C:
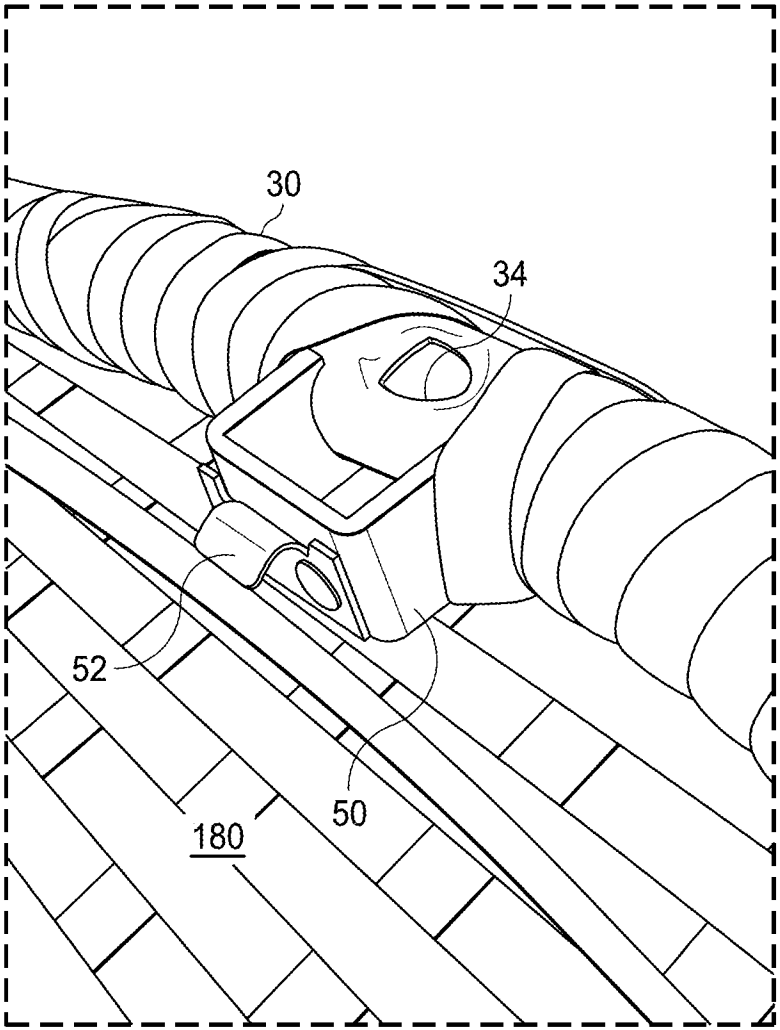
FIG. 6C is a close-up view of a latch receiver on a rear of the upper chair frame of FIG. 6A.
Figure 6B:
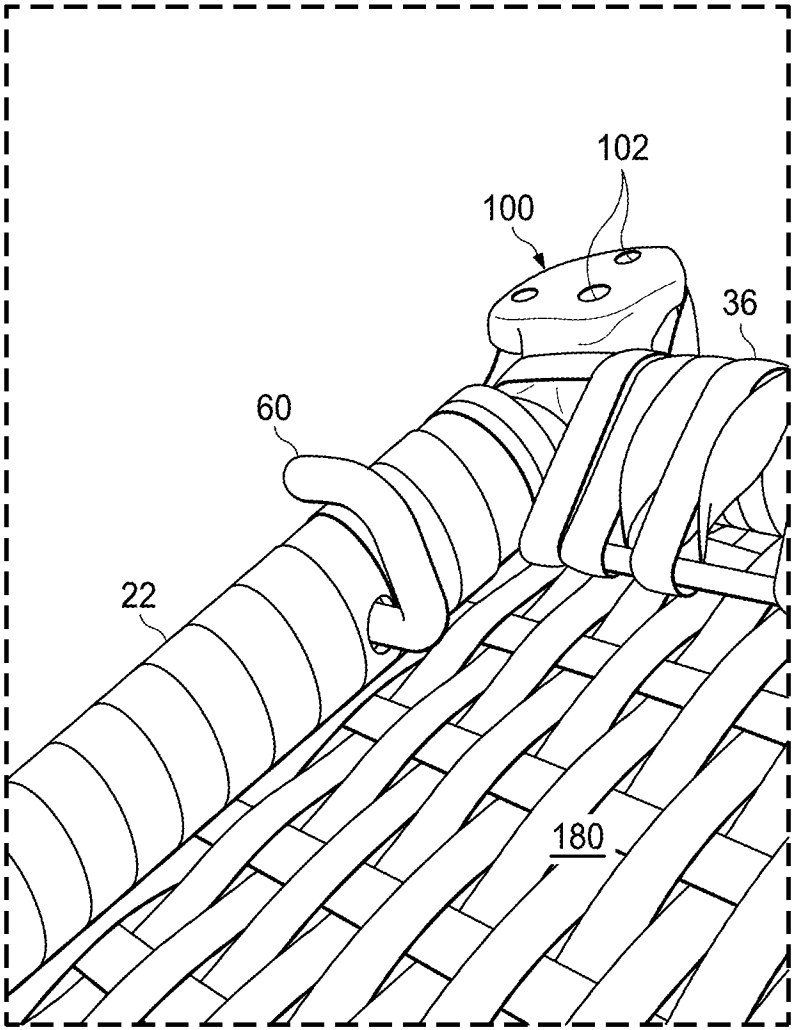
FIG. 6B is a close-up view of a front corner of the upper chair frame of FIG. 6A.
Figure 7A:
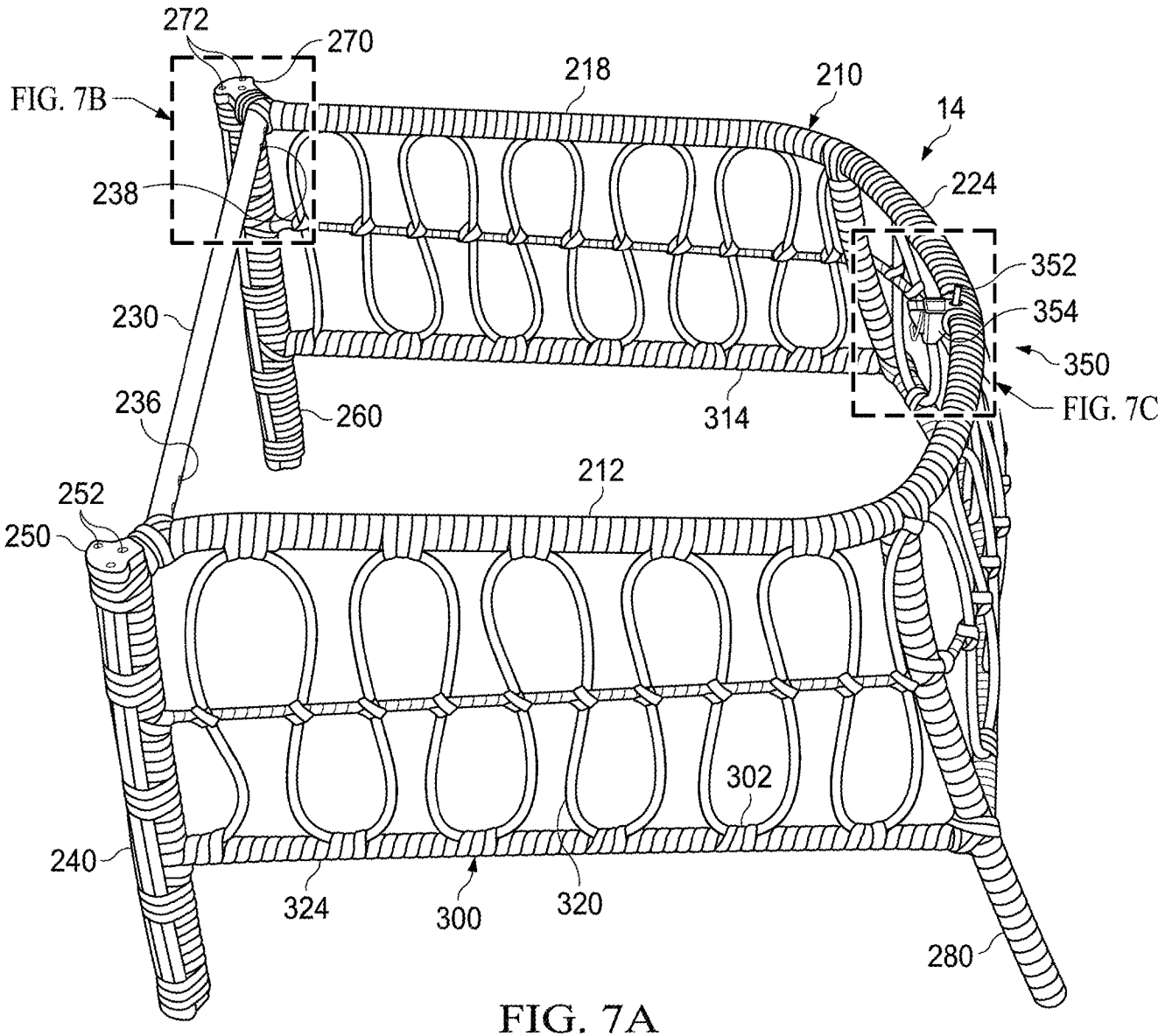
FIG. 7A is a perspective view of the lower chair frame of FIG. 1.
Figure 7C:
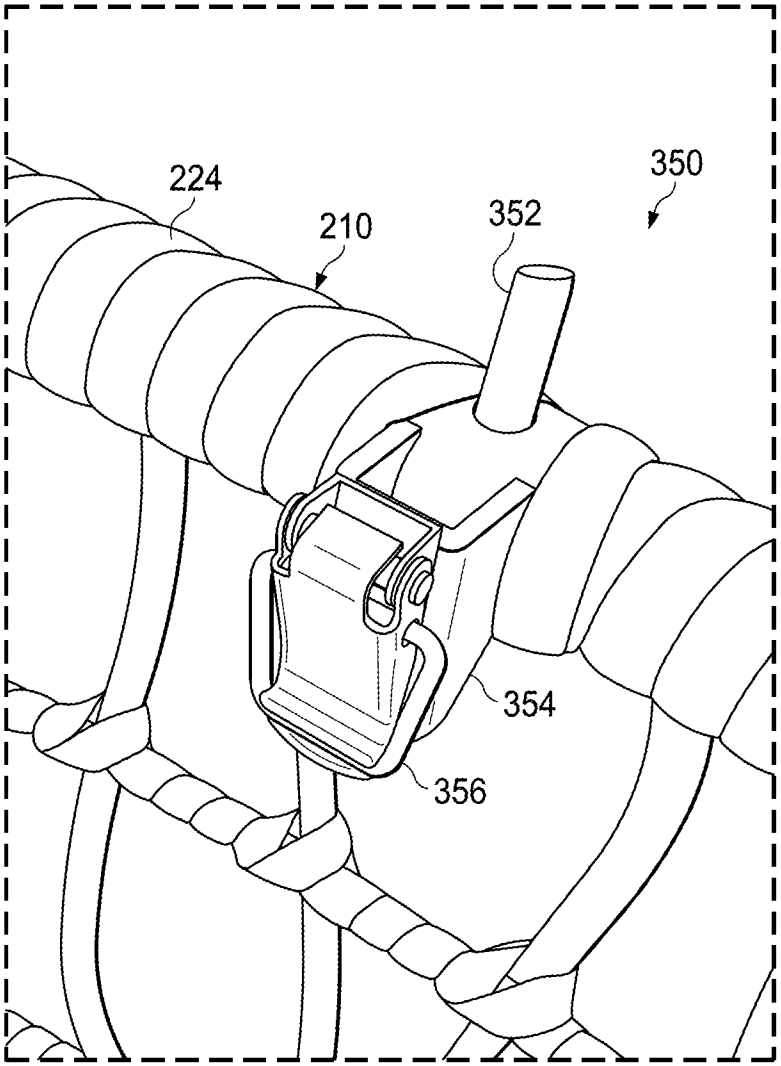
FIG. 7C is a close-up view of a rear interface mechanism on a rear of lower chair frame of FIG. 7A.
Figure 7B:
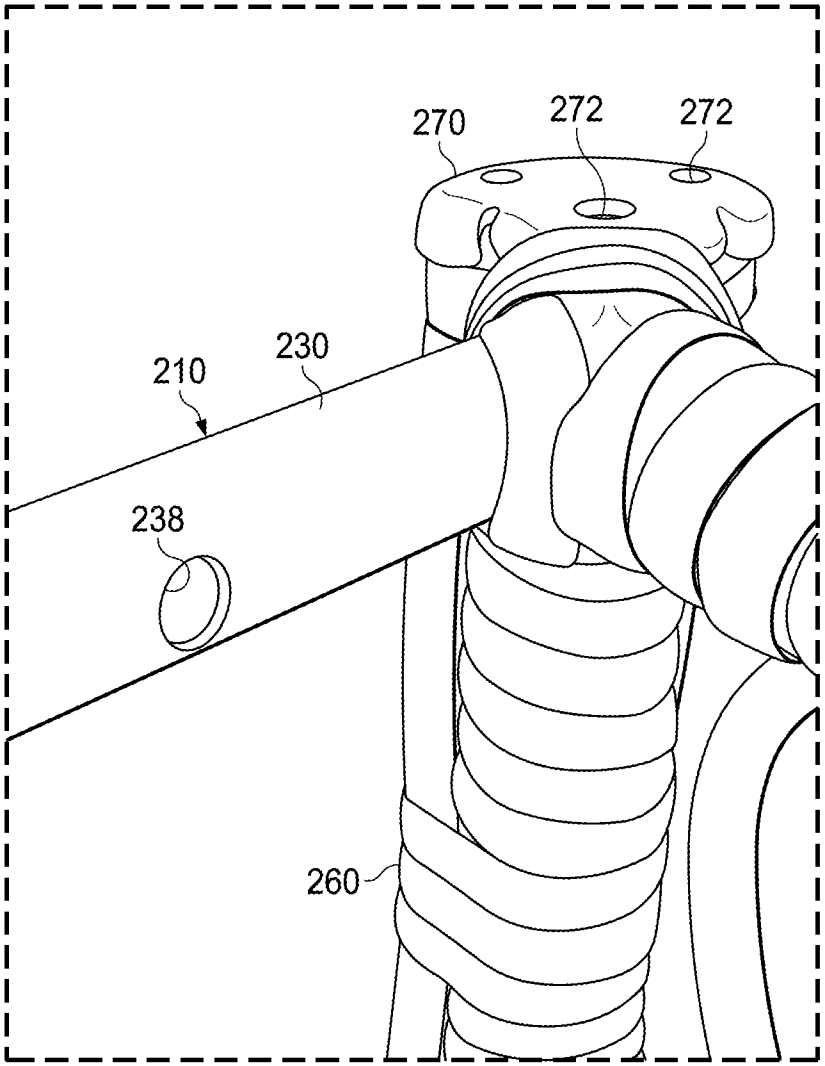
FIG. 7B is a close-up view of a front corner of the lower chair frame of FIG. 7A.
Figure 8A:
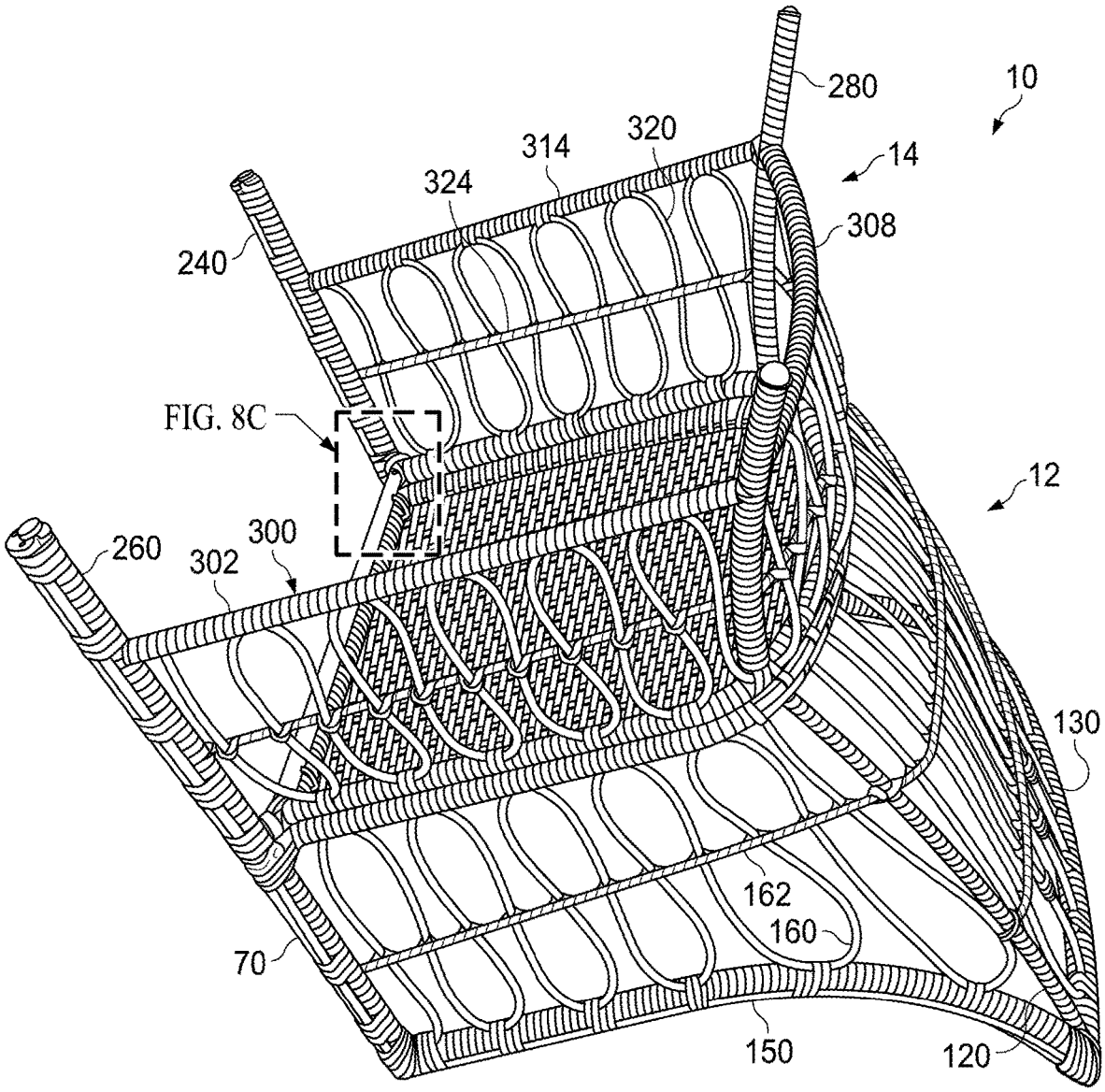
FIG. 8A is a perspective view of the chair of FIG. 1.
Figure 8C:
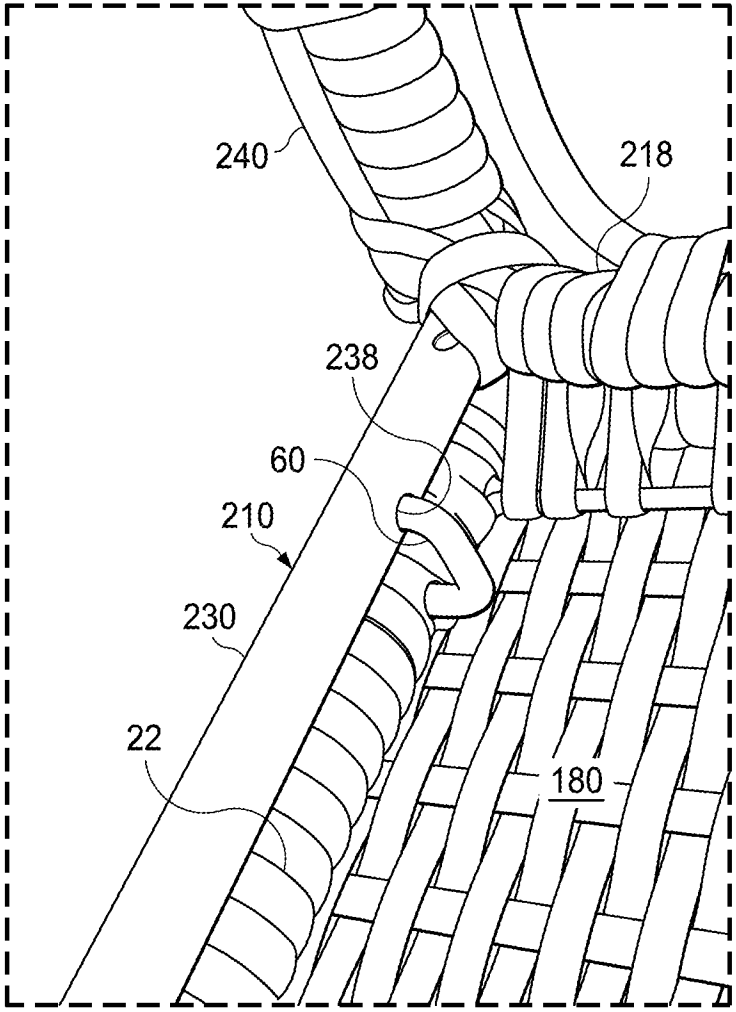
FIG. 8C is an enlarged view of a front interface of the upper chair frame and the lower chair frame of FIG. 8A, shown in an assembled configuration.
Figure 8B:
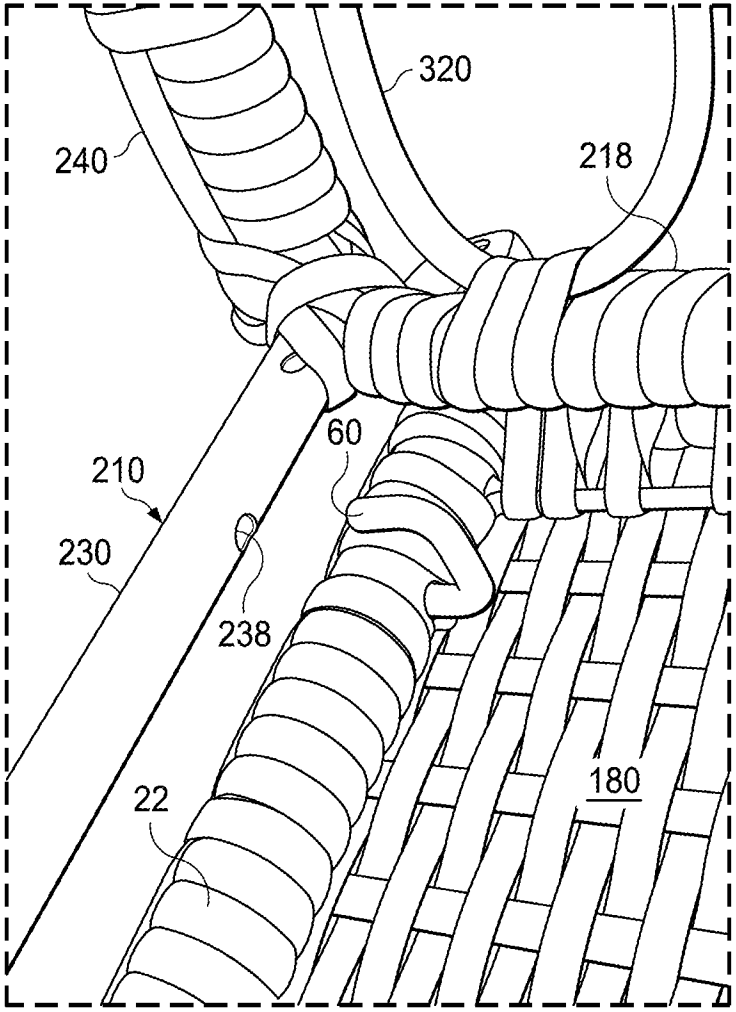
FIG. 8B is an enlarged view of a front interface of the upper chair frame and the lower chair frame of FIG. 8A, shown in an unassembled configuration.
Figure 9A:
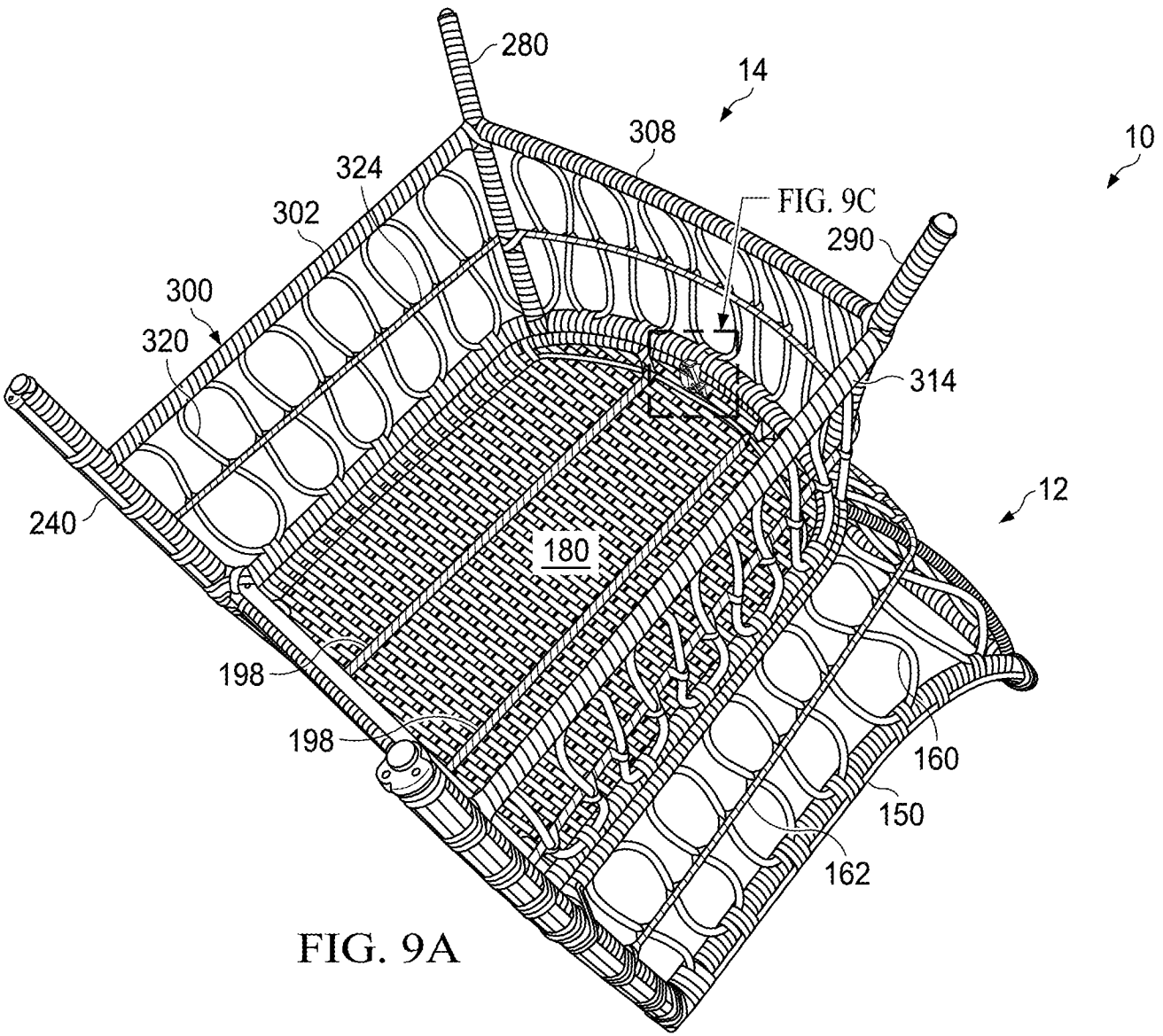
FIG. 9A is a perspective view of the chair of FIG. 1.
Figure 9C:
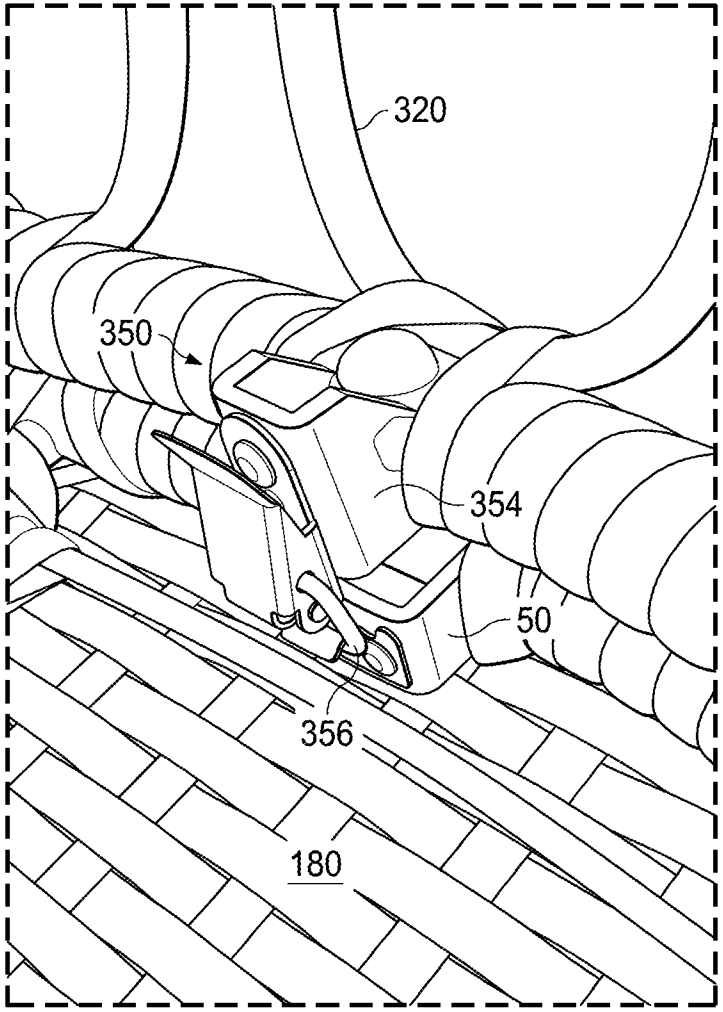
FIG. 9C is an enlarged view of a rear interface of the upper chair frame and the lower chair frame of FIG. 9A, shown in an assembled configuration.
Figure 9B:
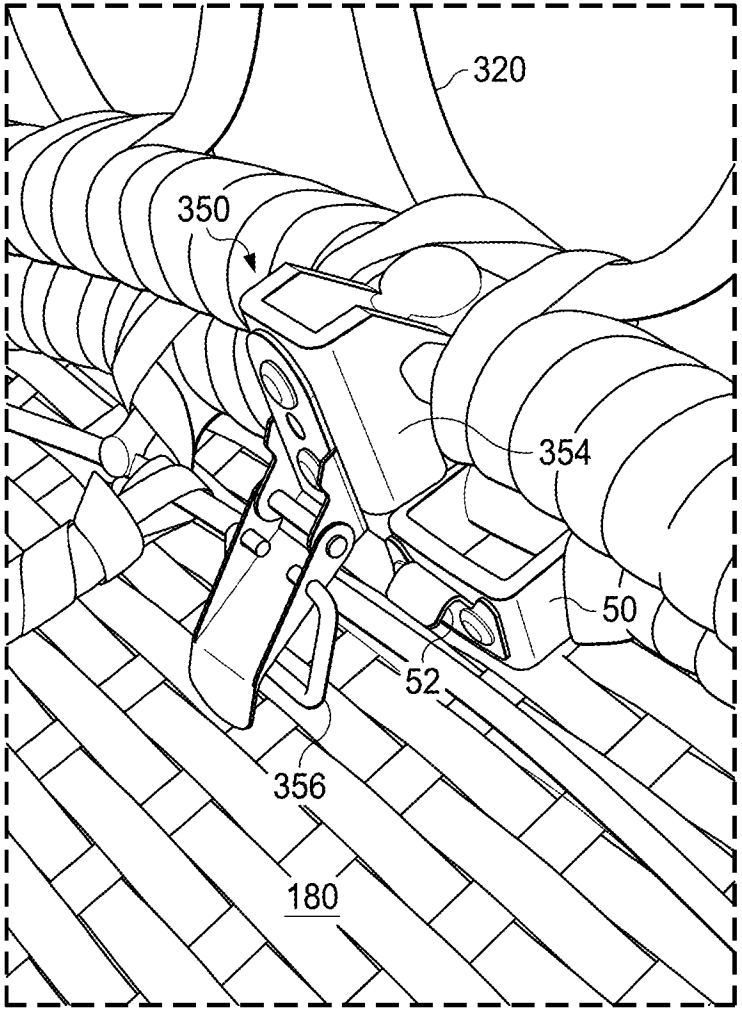
FIG. 9B is an enlarged view of a rear interface of the upper chair frame and the lower chair frame of FIG. 9A, shown in an unassembled configuration.

Second cap 100 (best seen in FIG. 6B) is located on the lower surface of second front upright tube 80. Second cap 100 defines second upper interface members 102. Members 102 may be orifices, protrusions or other members for engaging a mating cap.

First rear upright tube 110 extends above and proximate to the rear end of first side tube 36 and to the first end of rear tube 30. First rear upright tube 110 has an upper end.

Second rear upright tube 120 extends above and is proximate to the rear end of second side tube 40 and to the second end of rear tube 30. Second rear upright tube 120 has an upper end.

Top back tube 130 has a first end proximate to the upper end of first rear upright tube 110 and has a second end proximate to the upper end of second rear upright tube 120.

First arm rest tube 140 has a first end in communication with the top surface of first front upright tube 70 and a second end in communication with top back tube 130 proximate to the first end of top back tube 130 and proximate to the upper end of first rear upright tube 110.

Second arm rest 150 has a first end in communication with the top surface of second front upright tube 80 and has a second end in communication with top back tube 130 proximate to the second end of top back tube 130 and proximate to the upper end of second rear upright tube 120.

In one embodiment, upper chair frame 12 has upper webbing 160 that spans between first arm rest tube 140 and first side tube 36. Upper webbing 160 additionally spans between rear tube 30 and top back tube 130 and between second arm rest tube 150 and second side tube 40.

In one embodiment, first side tube 36, second side tube 40, and rear tube 30 are comprised of a single curved tube.

In one embodiment, upper webbing 160 includes lower horizontal webbing member 162 having a first end in communication with first front upright tube 70. Lower horizontal webbing member 162 passes adjacent to first rear upright tube 110, passes adjacent to second rear upright tube 120, and has a second end in communication with second front upright tube 80. Upper webbing 160 may include an upper horizontal webbing member 168 having a first end in communication with first rear upright tube 110 and having a second end in communication with second rear upright tube 120.

Seating member 180 is supported by seat frame 20 and spans between front tube 22, first side tube 36, second side tube 40, and rear tube 30.

Seating surface supports 198 may be provided under seating member 180. Seating surface supports 198 are preferably affixed to front tube 22 and have a rear end affixed to rear tube 30.

Lower chair frame portion 14 includes base seat support 210. Base seat support 210 includes first base seat bar 212 having a front end and a rear end. Base seat support 210 includes second base seat bar 218 having a front end and a rear end. Base seat support 210 includes rear base seat bar 224 having a first end and a second end. Base seat support 210 additionally includes front base seat bar 230 having a first end, a second end, and a first rearward facing orifice 236 for receiving the terminal end of first hook 60. Front base seat bar 230 additionally defines second rearward facing orifice 238 for receiving the terminal end of second hook 64. In one embodiment, first base seat bar 212, second base seat bar 210, rear base seat bar 224, and front base seat bar 230 are comprised of a single bar.

First front upright leg 240 has an upper end adjacent to the first end of front base seat bar 230 and to the front end of first base seat bar 212.

First cap 250 is provided on the upper end of first front upright leg 240. First cap 250 has a plurality of lower interfacing members 252 formed thereon.

Second front upright leg 260 has an upper end adjacent to the second end of front base seat bar 230 and to the front end of second base seat bar 218.

Second cap 270 is provided on the upper end of second front upright leg 260. Second cap 270 has a plurality of lower interfacing members 272 formed thereon.

First rear upright leg 280 has an upper end in communication with base seat support 210 proximate to the rear end of first base seat bar 212 and proximate to the first end of rear base seat bar 224.

Second rear upright leg 290 has an upper end in communication with base seat support 210 proximate to the rear end of second base seat bar 218 and proximate to the second end of rear base seat bar 224.

Lower base support bars 300 include first lower bar 302 having a front end and a rear end. Rear lower bar 308 has a first end and a second end. Second lower bar 314 has a front end and a rear end.

In one embodiment, first lower bar 302, rear lower bar 308, and second lower bar 314 of lower base support bars 300 are comprised of a single bar.

In one embodiment, lower webbing 320 spans between base seat support 210 and lower base seat bar 300. In one embodiment, lower webbing 320 includes first webbing support bar 324. First webbing support bar 324 has a front end in communication with first front upright leg 240 and a rear end in communication with first rear upright leg 280. Lower webbing 320 communicates with rear webbing support bar 330 having a first end in communication with first rear upright leg 280 and a second end in communication with second rear upright leg 290. Lower webbing 320 communicates with second webbing support bar 336 having a front end in communication with second front upright leg 260 and a rear end that communicates with second rear upright leg 290. Curved webbing member 392 has a first end in communication with first front upright leg 240. Portion 346 communicates with base seat support 210. Portion 348 communicates with lower base support bar 300.

A rear interface mechanism 350 is on rear base seat bar 224 of base seat support 210 of lower chair frame portion 14. Rear interface mechanism 350 includes post 352 protruding above an upper surface of rear base seat bar 224 for being received in rear orifice 34 of rear tube 30 of upper chair frame 12. Clasp support 354 extends forwardly of rear tube 30. Clasp support 354 supports clasp latch hook 356, which is affixed thereto for selective attachment to latch receiver 52 of upper chair frame 12.

Although "front", "rear", "upper" and "lower" are used in the specification, it should be understood that the orientation of the particular parts may be reversed, e.g., the rear interface mechanism 350 could be located on the front of chair 10 and hooks 60, 64 and orifices 236, 238 could be located on the rear of chair 10.

In use, upper chair frame 12 is placed on lower chair frame 14. A front interface is engaged between lower chair frame 12 and upper chair frame 14 for preventing relative movement between lower chair frame 12 and upper chair frame 14.

Rear interface 350 is engaged between lower chair frame 12 and upper chair frame 14 for preventing relative movement between lower chair frame 12 and upper chair frame 14. an orifice on at least one of said lower chair frame and said upper chair frame.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A chair adapted for no-tool assembly, said chair comprising:

a lower chair frame;

an upper chair frame supported by said lower chair frame;

a first interface between said lower chair frame and said upper chair frame for preventing relative movement between said lower chair frame and said upper chair frame;

a second interface between said lower chair frame and said upper chair frame for preventing relative movement between said lower chair frame and said upper chair frame;

wherein:

said upper chair frame comprises a first front upright member defining an lower end;

said upper chair frame comprises a second front upright member defining an lower end;

at least one of said lower ends of said first front upright member and said second front upright member is covered with a cap;

said cap comprises said first interface.

2. The chair according to claim 1 wherein said first interface comprises:

an orifice on at least one of said lower chair frame and said upper chair frame; and a protrusion for being received in said orifice, said protrusion on an opposite one of said lower chair frame and said upper chair frame.

3. The chair according to claim 2 wherein:

said lower chair frame comprises a first front leg and a second front leg connected by a front cross member;

said upper chair frame comprises a front cross member;

one of said front cross member of said lower chair frame and said front cross member of said upper chair frame defining said protrusion for being received in said orifice.

4. The chair according to claim 3 wherein:

said protrusion is a terminal end of a hook member.

5. The chair according to claim 2 wherein:

said first interface comprises at least one of said orifice and said protrusion.

6. The chair according to claim 1 wherein:

said lower chair frame comprises a first front leg defining an upper end;

said lower chair frame comprises a second front leg defining an upper end;

wherein at least one of said upper ends of said first front chair leg and said second front chair leg are covered with a cap;

wherein said cap comprises said first interface.

7. The chair according to claim 1 wherein said second interface comprises:

a latch receiver on one of said lower chair frame and said upper chair frame;

a latch for engaging said latch receiver, said latch on an opposite one of said lower chair frame and said upper chair frame.

8. A method of no-tool assembly for a chair, said method comprising:

placing an upper chair frame on a lower chair frame;

engaging a first interface between said lower chair frame and said upper chair frame for preventing relative movement between said lower chair frame and said upper chair frame;

engaging a second interface between said lower chair frame and said upper chair frame for preventing relative movement between said lower chair frame and said upper chair frame;

wherein:

said upper chair frame comprises a first front upright member defining an lower end;

said upper chair frame comprises a second front upright member defining an lower end;

at least one of said lower ends of said first front upright member and said second front upright member is covered with a cap;

said cap comprises said first interface.

9. The method according to claim 8 further comprising:

locating a protrusion on one of said lower chair frame and said upper chair frame in an orifice defined by an opposite one of said lower chair frame and said upper chair frame.

10. The method according to claim 9 wherein:

said lower chair frame comprises a first front leg and a second front leg connected by a front cross member;

said upper chair frame comprises a front cross member;

one of said front cross member of said lower chair frame and said front cross member of said upper chair frame define a protrusion for being received in said orifice.

11. The method according to claim 10 wherein:

said protrusion is a terminal end of a hook member.

12. The method according to claim 7 wherein:

said first interface comprises at least one of said orifice and said protrusion.

13. The method according to claim 8 wherein:

said lower chair frame comprises a first front leg defining an upper end;

said lower chair frame comprises a second front leg defining an upper end;

wherein at least one of said upper ends of said first front chair leg and said second front chair leg are covered with a cap;

wherein said cap comprises said first interface.

14. The method according to claim 8 wherein said second interface comprises:

engaging a latch receiver on one of said lower chair frame and said upper chair frame with a latch, said latch on an opposite one of said lower chair frame and said upper chair frame.

* * * * *